US005134966A

United States Patent [19]

Allen

[11] Patent Number: 5,134,966

[45] Date of Patent: Aug. 4, 1992

[54] PORTABLE APPARATUS FOR WETTING PREPASTED WALLCOVERING

[76] Inventor: Rosemary Allen, 3557 C Old Chamblee Tucker Rd., Atlanta, Ga. 30340

[21] Appl. No.: 484,258

[22] Filed: Jun. 1, 1990

[51] Int. Cl.[5] ..... B05C 3/15

[52] U.S. Cl. ..... 118/419; 118/428; 118/429; 118/DIG. 17

[58] Field of Search ..... 118/423, 419, 428, DIG. 17, 118/429

[56] References Cited

U.S. PATENT DOCUMENTS 1,523,257 1/1925 Butler ..... 118/DIG. 17
4,300,471 11/1981 Desjardins ..... 118/419
4,377,983 3/1983 Skarsten ..... 118/42
4,524,714 6/1985 Hohenhövel ..... 118/123
4,582,019 4/1986 Bärschneider ..... 118/246

*Primary Examiner*—Michael G. Wityshyn

[57] ABSTRACT

The apparatus has a spindle rod on which a supply roll of wallcovering is placed, a tensioning rod under which the wallpaper is entrained as it is drawn from the supply roll, a powered take-up roll on which the wallpaper is rolled up, and provisions to readily reposition the tensioning rod so as to force the wallpaper to pass under water contained in a tray. Quick-release fastening devices permit the apparatus to be readily assembled to constitute a carry case with all parts contained, subsequently quickly opened and put into operation, and subsequently the water tray and rods snapped out for cleaning. All parts, including all the structural members, can be easily carried to a sink, tub, or yard hose for rinsing.

3 Claims, 2 Drawing Sheets

PORTABLE APPARATUS FOR WETTING PREPASTED WALLCOVERING

BACKGROUND OF THE INVENTION

In my work I do small residential remodeling jobs including wallpapering, and I searched for a small, self-contained, portable machine. I found only large, heavy, machines which were hard to transport. That necessity inspired this invention.

OBJECT OF THE INVENTION

The object of the invention is to provide a light weight portable machine for wetting wallcovering, said machine having parts to assemble quickly and easily to be carried to a new job site, all parts being contained in a carrying case mode; the machine then being quickly and easily set up to operate, and then easily disassembled to wipe or rinse before assembling to carry away.

DESCRIPTION OF THE INVENTION

Figure 1:
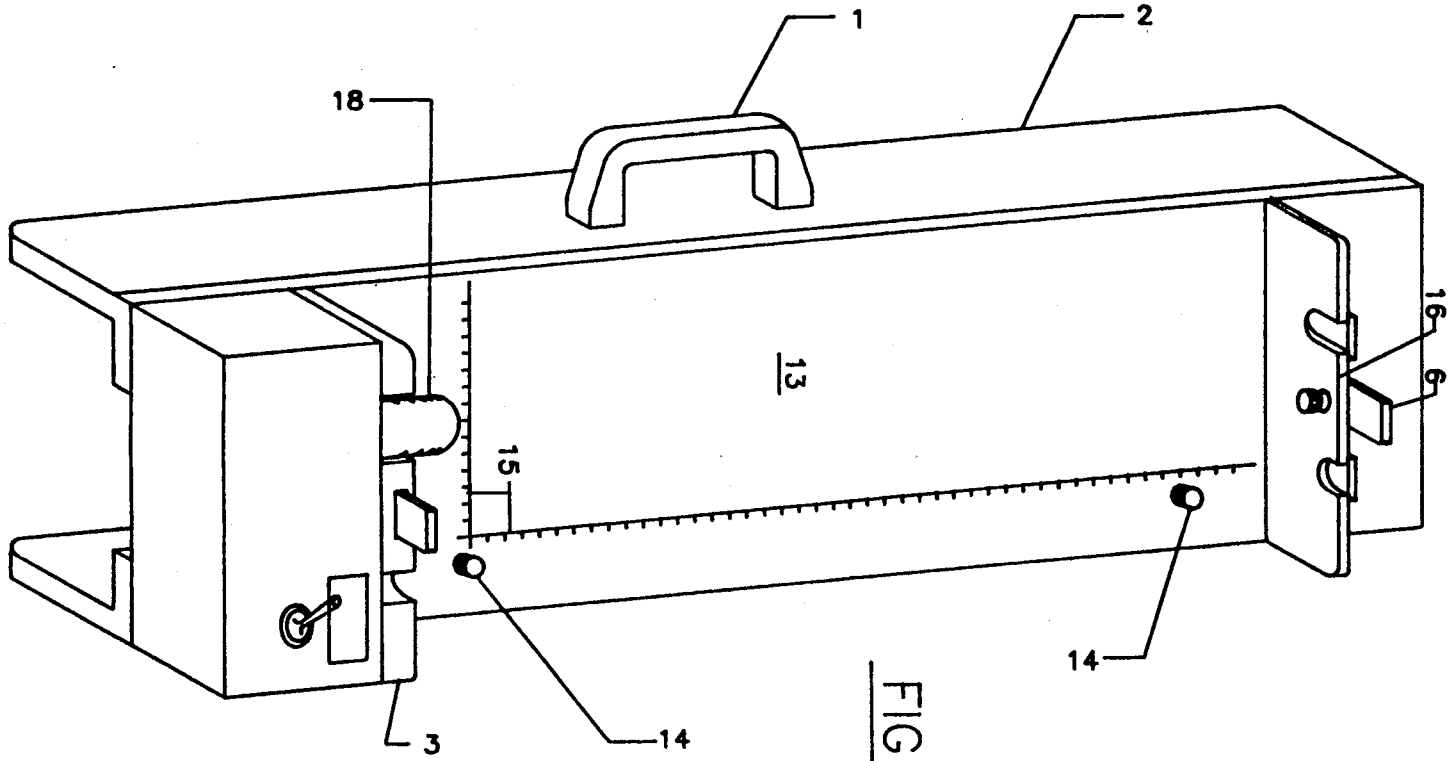
FIG. 1 shows the apparatus with the lid closed and assembled in a carry case mode.

FIG. 1 shows the apparatus assembled as a closed case, with the exterior parts comprising the case and the loose parts and accessories being contained in the interior. Handle 1 is for hand carrying of the machine. Scale markings 15 on lid 13 are to assist in measuring wallcovering for cutting.

Figure 2:
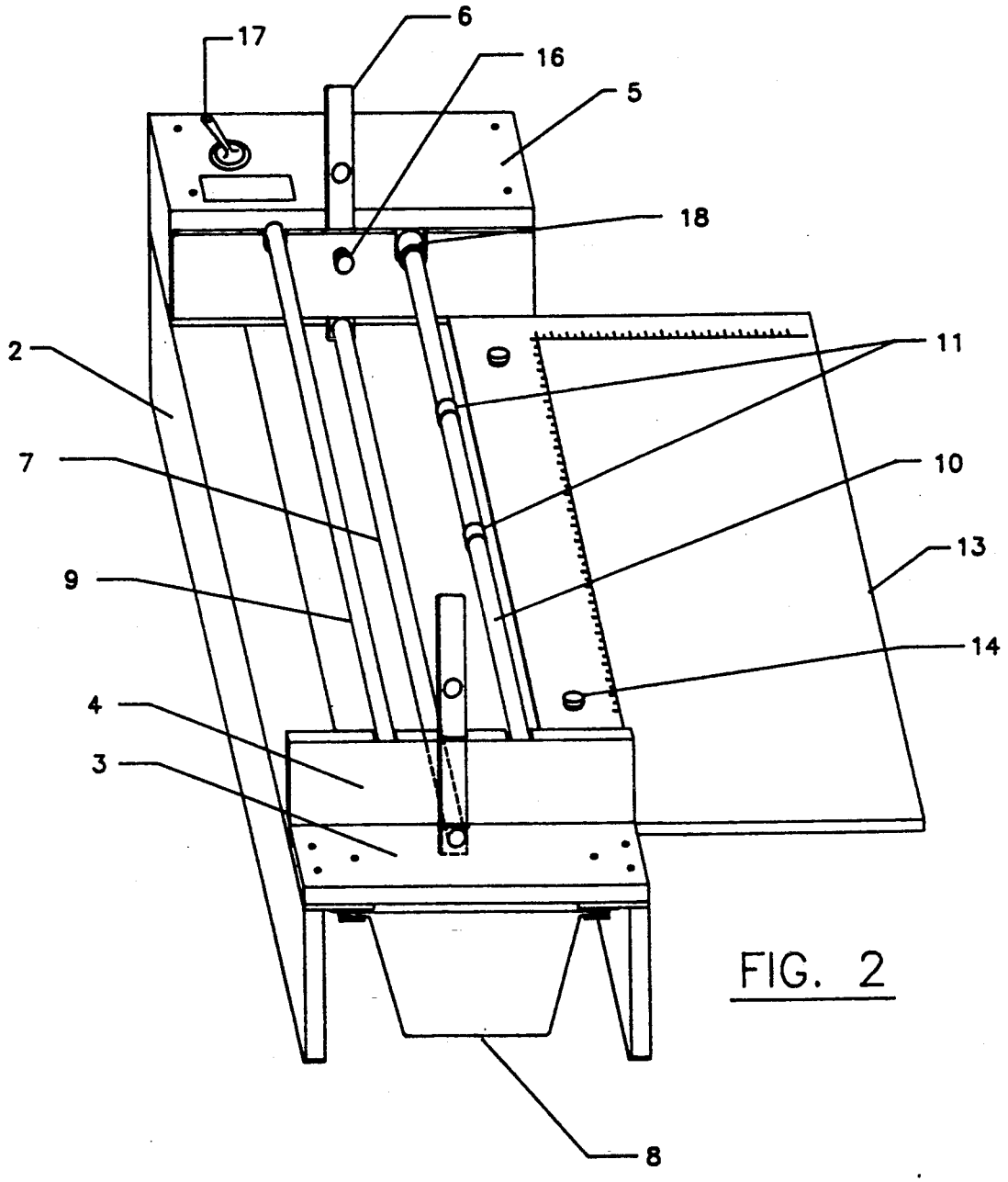
FIG. 2 shows the apparatus with the lid opened and set up for operation.

FIG. 2 shows lid 13 partially slid off and extended to serve as a work surface, secured by spring-loaded securing snaps 14. Side frame members 2 are secured in place by cross-members 3.

Support members 4 are shaped to support supply spindle rod 9, take-up spindle rod 10 and end brackets 6. A tensioning rod 7 has end brackets 6 shown held in the raised position and secured to support member by spring-loaded snaps 16. Tray 8 is shown in place. Clips 11 are diagrammatically show, but may be in any convenient form. Housing 5 covers a motor and drive and supports on-off switch 17. Coupling 18 engages the drive when the take-up shaft 10 is in place.

The machine is of plastic construction and needs to bear only light loads of wallcovering, hence it is built of light weight members, essentially of hard plastic. In the preferred embodiment, the machine is the proper size to handle domestic sized rolls of prepasted wallcovering 27" wide or less.

To operate, the machine is carried into the building and placed on a flat surface, such as a counter or table or straight chair. The lid 13, shown closed in FIG. 1, is opened as shown in FIG. 2. The tray 8 is found to contain the supply spindle rod 9 and the take-up spindle rod 12. The tensioning rod 7 is found in the lowered position and its supporting brackets 6 are now manually pulled up and snapped into the raised position. The tray 8 is partially filled with wetting liquid. Supply rod 9 is picked up and a roll of wallpaper slid onto the rod. One end of the wallpaper sheet is passed under the tensioning rod 7 and the wallpaper end clipped to the take-up rod 10 by suitable clips 11. The supporting brackets 6 are manually pushed down and snapped into position. This lowers the tensioning rod 7 down into the wetting liquid. With everything in place, the motor is started and left running until the roll is wetted and rolled up, the motor is then stopped and the take-up rod picked up and the wetted roll removed. While the next roll is processed, the operator may leave the machine unattended while hanging the wetted roll. No harm is done if the roll continues to revolve after the supply is exhausted. When ready to leave the job the operator removes and empties the tray, rinses the tray, and other parts as necessary, repositions the tray, drops the rods and other accessories into the tray and snaps the lid closed.

The machine emphasizes improvements in portability; i.e., the working parts being so easily picked up and replaced for operation, ease of loading and unloading the wallpaper ease of cleaning up, and further the ease of placing all loose parts and accessories in the unit and closing the lid, with even a frail person walking out with the whole unit in one hand.

I claim:

1. A portable apparatus for wetting prepasted wallcovering comprising:

a frame with a carrying handle attached thereto, said fame comprising means for supporting a supply spindle rod, a take-up spindle rod, a tray, a drive means, a slidable lid and a tension assembly;

said slidable lid being horizontally slidable between a closed position and an open position;

said slidable lid providing in its open position a work area which is lined with a measuring scale on one or more edges thereof;

said tray being removably mounted on said frame for providing a supply of a wetting liquid;

said supply spindle rod being removably mounted on said frame for supporting a supply roll of wallcovering thereon;

said tension assembly comprising a pair of end brackets and a tensioning rod secured to said end brackets, said end brackets being shiftably mounted to said frame between upper and lower positions such that the tensioning rod when in said lower position guides the wallcovering through said wetting liquid in said tray; and said take-up spindle rod being removably mounted on said frame and connectable to said drive means which when actuated will turn said take-up spindle rod and pull wallcovering attached to the take-up spindle rod from the supply roll under the tensioning rod and through the tray and onto the take-up spindle rod.

2. A portable apparatus for wetting prepasted wallcovering as claimed in claim 1 wherein said frame comprises:

a pair of vertical side frame members, one said side frame member carrying said handle thereon;

a pair of cross members fastened to said frame members; and a pair of support members fastened to said cross members, said support members having means for supporting the ends of said supply spindle rod, the ends of said take-up spindle rod, and said end brackets of said tensioning rod.

3. A portable apparatus for wetting prepasted wallcovering as claimed in claim 1 wherein the drive means comprises a drive motor.

* * * * *